United States Patent [19]

Kukoleck et al.

[11] Patent Number: 4,953,190

[45] Date of Patent: Aug. 28, 1990

[54] THERMAL EMISSIVE COATING FOR X-RAY TARGETS

[75] Inventors: Dennis G. Kukoleck, Broadview Heights; Peter C. Eloff, Cleveland Heights, both of Ohio

[73] Assignee: General Electric Company, Milwaukee, Wis.

[21] Appl. No.: 373,723

[22] Filed: Jun. 29, 1989

[51] Int. Cl.[5] ..... H01J 35/10

[52] U.S. Cl. ..... 378/129; 378/127; 378/144; 427/421

[58] Field of Search ..... 378/127-129, 378/143-144; 427/421; 313/40, 45, 311, 355

[56] References Cited

U.S. PATENT DOCUMENTS

| | | | |
|---|---|---|---|
| 3,919,124 | 11/1975 | Friedel et al. | 252/520 |
| 3,993,923 | 11/1976 | Magendans et al. | 313/311 |
| 4,029,828 | 6/1977 | Bildstein et al. | 427/34 |
| 4,090,103 | 5/1978 | Machenschalk | 378/129 |
| 4,132,916 | 1/1979 | Hueschen et al. | 313/330 |
| 4,516,255 | 5/1985 | Petter et al. | 378/143 |

FOREIGN PATENT DOCUMENTS

| | | | |
|---|---|---|---|
| 2305018 | 10/1976 | France | 378/144 |
| 0141153 | 11/1981 | Japan | 378/143 |
| 7606662 | 12/1976 | Netherlands | 378/143 |

*Primary Examiner*—Janice A. Howell
*Assistant Examiner*—John C. Freeman

[57] ABSTRACT

A high thermal emittance coating for an x-ray tube anode target which permits broader application parameters and a stable coating. The coating is composed of $Al_2O_3$ present in an amount of 50% to 80% by weight and $ZrO_2$ or $La_2O_3$ and $TiO_2$ present in an amount of 50% to 20% by weight with the $TiO_2$ and $ZrO_2$ or $La_2O_3$ being present in a ratio in the range of 1:1 to 10:1. A preferable coating is composed of about 80% by weight of $Al_2O_3$ and 20% by weight of $TiO_2$ and $ZrO_2$.

12 Claims, 1 Drawing Sheet

FIG. 1
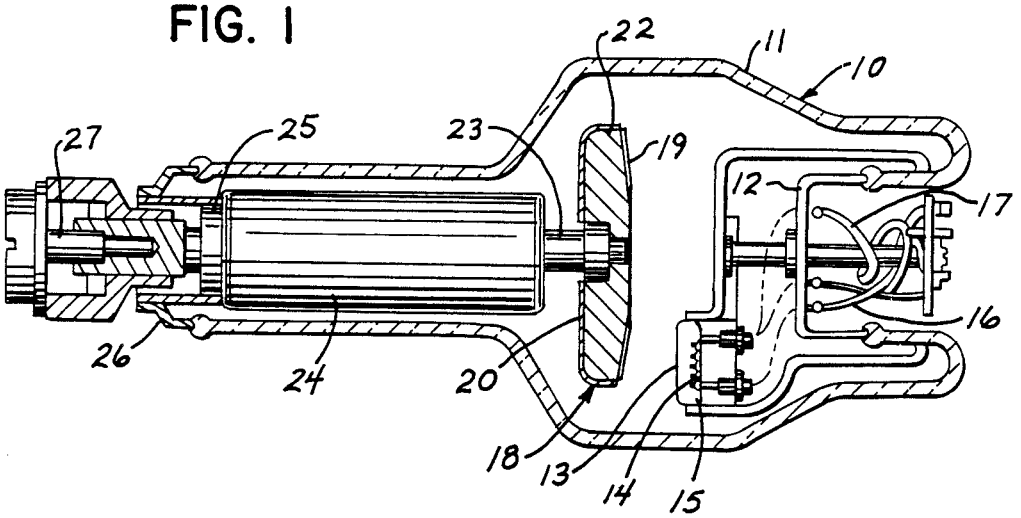
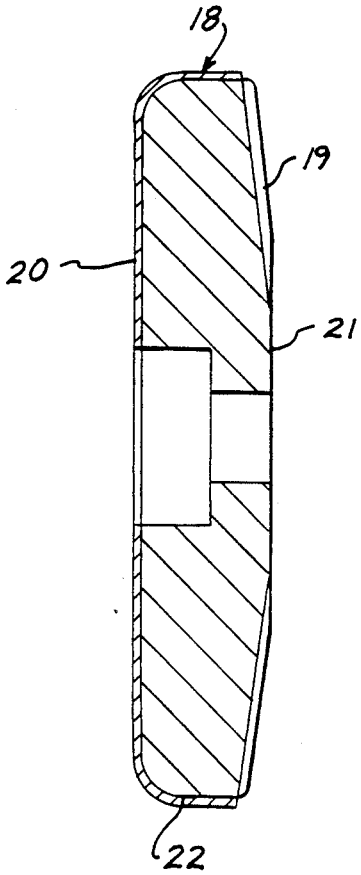
FIG. 2

THERMAL EMISSIVE COATING FOR X-RAY TARGETS

BACKGROUND OF THE INVENTION

This invention relates to an improved coating for thermal emittance of an x-ray tube anode. In particular, the invention discloses a coating which has improved bonding to the x-ray tube anode as well as high thermal emittance.

As stated in U.S. Pat. No. 4,132,916 which is commonly assigned, it is well known that of the total energy involved in an electron beam striking an x-ray target, only 1% of the energy is converted into x-radiation with the remainder of about 99% being converted into heat. As explained in this patent under the "Background of the Invention", it is well known that thermal emittance of x-ray tube anode targets can be enhanced to some extent by coating the target surface outside of the focal spot track with various coating compounds. The emitted heat is radiated through a glass envelope of the x-ray tube and ultimately to the oil circulating in the tube casing.

A variety of thermal emittance enhancing coatings have previously been used. For example, in the above referred to U.S. Pat. No. 4,132,916 there is described a coating composed of zirconium dioxide ($ZrO_2$), hafnium oxide (HfO), magnesium oxide (MgO), strontium oxide (SrO), cerium dioxide ($CeO_2$) and lanthanum oxide ($La_2O_3$) or mixtures thereof stabilized with calcium oxide (CaO) or yttrium oxide ($Y_2O_3$) and mixed with titanium dioxide ($TiO_2$). This coating provides a "fused" coating on the x-ray anode. While this coating has been commercially acceptable, it has had some problems with low heat emittance. More importantly, the process for applying it to the anode requires stringent parameters. In addition, there have been problems when applying the coating on some alloy substrates and its tendency to "run" onto noncoated areas during required fusing treatment thereby requiring further processing steps. One of the more serious problems has been the fact that during vacuum firing of the coating on the anode, the temperature must be kept below 1400° C. This also limits the user's ability to outgas the anodes prior to tube assembly.

In U.S. Pat. No. 4,029,828 there is described an x-ray tube target coating composed of 80-94% alumina ($Al_2O_3$) and 6–20% $TiO_2$. While this particular coating has good heat emissity, there have been problems with adhesion.

In U.S. Pat. No. 4,090,103 there is disclosed a coating layer composed of molybdenum, tungsten, niobium and/or tantalum metals in combination with a 20–60 volume percent of a ceramic oxide such as $TiO_2$, $Al_2O_3$ and/or $ZrO_2$. The coatings in this and the '828 patent provide a "non-fused" coating on the x-ray anode which present stability problems under normal operations.

SUMMARY OF THE INVENTION

The invention provides an x-ray tube anode which includes a body having a surface region for being impinged by electrons to produce x-radiation. A coating is placed distinct from the region for enhancing the thermal emittance of the body. The coating is composed of a metal oxide wherein $Al_2O_3$ is present in an amount of 50% to 80% by weight of the coating and $TiO_2$ together with $ZrO_2$ or $La_2O_3$ are present in an amount of 50% to 20% by weight of the coating with the $TiO_2$ and being present with respect to the $ZrO_2$ or $La_2O_3$ in a ratio in the range of 1:1 to 10:1. The coating has a heat emittance of as high as 0.91 with 1.0 being the theoretical maximum emittance of a black body.

In a preferred manner, the $Al_2O_3$ is present in an amount of about 80% and the $ZrO_2$ and the $TiO_2$ are present in an amount of about 20% of the coating.

A coating material is also presented for an x-ray tube anode which enhances the thermal emittance. The coating is composed of the previously described metal oxides characterized by $Al_2O_3$ particles projecting from the coating when the coating is fused to the anode. This results in a combined "fused" and "non-fused" coating.

A method of producing a high thermal emittance coating on an x-ray tube anode is also presented which includes the steps of depositing on selected surface regions of the anode the previously described metal oxide mixture. The anode is heated under vacuum conditions and at a temperature of at least 1600° C. and as high as 1725° C. for a sufficient time to cause the coating mixture to fuse into a smooth black coating with the alumina particles projecting from the coating.

It is an object of the present invention to provide an x-ray tube anode coating material which affords broader application parameters with respect to the anode.

Another object is a coating material of the foregoing type which has high heat emissivity.

Still another object is to provide a coating composition which affords both a "fused" and "non-fused" anode coating, and does not run or migrate during firing.

These and other objects and advantages of the invention will be apparent from the following detailed description and drawing.

DESCRIPTION OF THE DRAWINGS

FIG. 1 is a typical rotating anode x-ray tube, shown in section, in which the target coating material of this invention is used; and FIG. 2 is a cross section of the x-ray anode target body shown in FIG. 1.

DESCRIPTION OF A PREFERRED EMBODIMENT

In FIG. 1, the illustrative x-ray tube generally 10 comprises a glass envelope 11 which has a cathode support 12 sealed into one end. A cathode structure 13 comprising an electron emissive filament 14 and a focusing cup 15 is mounted to support 12. There are a pair of conductors 16 for supplying heating current to the filament and another conductor 17 for maintaining the cathode at ground or negative potential relative to the target of the tube.

The anode or target on which the electron beam from cathode 13 impinges to produce x-radiation is generally designated by the reference numeral 18. Target 18 will usually be made of a refractory metal such as molybdenum or tungsten or alloys thereof but in tubes having the highest rating the target is usually tungsten on a molybdenum alloy substrate. A surface layer on which the electron beam impinges while the target is rotating to produce x-rays is marked 19 and is shown in cross section in FIGS. 1 and 2. Surface layer 19 is commonly composed of tungsten-rhenium alloy for well-known reasons.

The rear surface 20 of target 18 is preferably flat in this example and is one of the surfaces on which the new high thermal emittance coating may be applied. If desired, a concave or convex surface could be employed. The coating may also be applied to areas of the target outside of the focal spot track such as the front surface 21 and the peripheral surface 22 of the target.

In FIG. 1 the target 18 is fixed on a shaft 23 which extends from a rotor 24. The rotor is journaled on an internal bearing support 25 which is, in turn, supported from a ferrule 26 that is sealed into the end of the glass tube envelope 11. The stator coils for driving rotor 24 such as an induction motor are omitted from the drawing. High voltage is supplied to the anode structure and target 18 by a supply line, not shown, coupled with a connector 27.

As is well known, rotary anode x-ray tubes are usually enclosed within a casing, not shown, which has spaced apart walls between which oil is circulated to carry away the heat that is radiated from rotating target 18. The bulk temperature of the target often reaches 1350° C. during tube operation and most of this heat has to be dissipated by radiation through the vacuum within tube envelope 11 to the oil in the tube casing which may be passed through a heat exchanger, not shown. It is common to coat the rotor 24 with a textured material such as titanium dioxide to increase thermal emittance and thereby prevent the bearings which support the rotor from becoming overheated. If the heat storage capacity of the target 18 is not great enough or if its cooling rate is low, duty cycles must be shortened which means that the tube must be kept deenergized until the target reaches a safe temperature. This often extends the time required for an x-ray diagnostic sequence. Hence, it is important that the emittance of the target surfaces be maximized.

The following examples are set forth for the purpose of illustrating the present invention and should not be construed to limit the invention to the precise ingredients, proportions, temperatures or other conditions specified.

EXAMPLE 1

A coating composed of 80 percent $Al_2O_3$, 18 percent $TiO_2$, and 2 percent $ZrO_2$ (calcia-stabilized, 4%) was applied to 96 molybdenum-based alloy anodes such as 18 on the surfaces 20 opposite the tungsten alloy focal track 19 by plasma spray deposition. The as-sprayed coating thickness was 3.0 to 3.8 mils as measured by an eddy-current device. The coated anodes were fired in a high-vacuum furnace at 1650 degrees C. for 30-35 minutes, after which the coatings had a matte, black appearance. There was no visual evidence of coating migration or "running" to areas beyond those initially coated. Thermal emittance in the 2 micron wavelength range at room temperature was measured to be 0.90–0.91.

EXAMPLE 2

Sixteen of the coated anodes prepared in Example 1 were repeatedly heated in vacuum to 1600 degrees C. a total of 14 times. There was no visual degradation or running of the coatings, and emittance was measured to be 0.89.

EXAMPLE 3

Four anodes were coated by plasma-spraying the composition described in 1., above, and vacuum-fired at 1600 degrees C. for 30 minutes. The fired coatings appeared visually identical to those described in Example 1, but energy-dispersive x-ray analysis (EDAX) showed the presence of some argon in the coating, probably due to incomplete outgassing during firing. This indicates that higher firing temperatures are required for this formulation.

EXAMPLE 4

Four anodes were coated by plasma-spraying the composition as described in Example 1, above, and vacuum-fired at 1625 degrees C. for 30 minutes. The fired coatings appeared visually identical to those of Example 1, and were similar in EDAX analysis.

EXAMPLE 5

Four anodes were coated by plasma-spraying the composition described in Example 1, above, and vacuum-fired at 1700 degrees C. for 30 minutes. The fired coatings appeared visually identical to those of Example 1, and were similar in EDAX analysis.

EXAMPLE 6

Four anodes were coated by plasma-spraying the composition described in Example 1, above, and vacuum-fired at 1750 degrees C. for 30 minutes. The fired coatings appeared crystalline, and there was a light film of black coating extending to areas of the anodes which were not originally coated. This is termed "running". This indicates that the temperature of 1750 degrees C. was too high for this formulation.

EXAMPLE 7

Four anodes were coated by plasma-spraying the composition described in Example 1, above, and vacuum-fired at 1725 degrees C. for 30 minutes. The fired coatings appeared visually identical to those of Example 1, above.

EXAMPLE 8

A coating composed of 80 percent $Al_2O_3$, 4 percent $TiO_2$, and 16 percent $ZrO_2$ (calcia-stabilized, 4%) was applied to four molybdenum-based alloy anodes in the manner indicated in Example 1, above. The as-sprayed coating thickness was the same, as measured by an eddy-current device. The coated anodes were fired in a high-vacuum furnace at 1700 degrees C. for 30 minutes, after which the coatings had a matte, grey-black appearance, with no running. The emittance value was measured to be only 0.7.

EXAMPLE 9

A coating composed of 50% $Al_2O_3$, 10% $TiO_2$ and 40% $ZrO_2$ was applied to four molybdenum-based alloy anodes in the manner indicated in Example 1, above. The coated anodes were fired in a high-vacuum furnace at 1650° C. for 30 minutes. While the coating had good heat emittance at 0.87, the coating did run when applied to the anode.

It should be pointed out that while 18% $TiO_2$ as well as 2% $ZrO_2$ have been illustrated in the Examples in combination with 80% alumina to produce successful coatings, successful coatings have also been applied using 15% $TiO_2$ and 5% $ZrO_2$ as well as 10% each of $TiO_2$ and $ZrO_2$. Thus, it is within the scope of this invention to employ $Al_2O_3$, $TiO_2$ and $ZrO_2$ within the following range of amounts which are expressed in weight % of the coating:

| | |
|---|---|
| $Al_2O_3$ | 50–80 |
| $TiO_2$ | 10–25 |
| $ZrO_2$ | 2–25 |

with the indicated amounts of $TiO_2$ and $ZrO_2$ when combined being in the range of 50–20% of the coating.

The foregoing Examples, as well as the additionally tested coatings stated herein, illustrate the importance of maintaining the ratio of $TiO_2$ to $ZrO_2$ in the range of 1:1 to 10:1. Compare Examples 1, 2, 4, 5 and 7, and those coatings successfully using 15% $TiO_2$ and 5% $ZrO_2$ as well as 10% each of $TiO_2$ and $ZrO_2$ with Examples 8 and 9.

As illustrated in the preceding examples, one desirable way of depositing the oxide mixture on the target is to spray it on with a plasma gun. The plasma gun is a well-known device in which an electric arc is formed between a tungsten electrode and a surrounding copper electrode. The oxide materials are conveyed through the arc in a stream of argon gas. While passing through the plasma created by the recombination of the ionized gas atoms, the particles are melted and projected toward the target surface by the gas stream. The molten particles impinge on the surface being coated to effect an initial bond. The as-sprayed coating has a light grey color. Subsequent vacuum firing results in the coating having a combined non-fused and fused glossy appearance with $Al_2O_3$ particles projecting from the coating. This has been observed with a scanning electron micrograph. The fired coating has a matte black color.

The coating may be applied by other methods. The oxides may be entrained in a suitable binder or other volatile fluid vehicle and sprayed or painted on the target surface. The oxides may also be vacuum sputtered in an inert gas or the metals which comprise the oxides may be vacuum sputtered in a partial pressure of oxygen to produce the oxide coatings.

As stated in the previously referred to '916 patent, in the case of plasma arc spraying, the $TiO_2$ which is originally white is partially stripped of oxygen since the plasma arc operates at very high temperature. At this stage of the process, the white $TiO_2$ in the mixture is converted to blue-black. Depending upon the amount of $TiO_2$ in the mixture, the coating, after spraying, has a thermal emittance in the range of about 0.6 to 0.85 and, upon inspection with the naked eye or with very little magnification, the coating appears textured and particulate. Under these circumstances, diffusion and bonding with the target's surface metal is not maximized as yet.

After the coating material is deposited uniformly by any of the suggested methods, the next step in the process is critical in optimizing the thermal emittance and in producing a fused coating in which some of the particles can be discerned. Thus, the next step is to fire the coated x-ray target in a vacuum, actually at low pressure of $10^{-5}$ Torr or less, to produce a fused black coating in which the $TiO_2$ is further deficient in oxygen. The firing temperature should be at least 1600° C. and should not exceed 1725° C. If the temperature is too high, the fused coating may run or flow to areas not intended to be coated.

The oxide composition, after fusing in vacuum, becomes a coating which is stable in the high vacuum of an x-ray tube at least up to 1600° C., which is above any expected temperature for the target outside of the focal track. Coatings formed in accordance with this method, have consistently exhibited thermal emittances of 0.90 to 0.91.

It will be evident to those skilled in the art that the target 18 could not be fired when attached to rotor 24 since the copper and steel portions of the rotor would melt at 1083° C. and 1450° C., respectively.

In the preferred embodiment, the zirconia is stabilized with 4% by weight of calcia. If desired, the amount of calcia could be increased to 8%. Alternatively, a stabilizer such as yttrium oxide could be employed in the same amount by weight.

Also while $ZrO_2$ is the preferred material to be employed in combination with $Al_2O_3$ and $TiO_2$, lanthanum oxide ($La_2O_3$) could be used in place thereof. It could be applied to the anode surface 20 in the same manner as described for the coating composition with $ZrO_2$.

We claim:

1. An x-ray tube anode comprised of a body having a surface region for being impinged by electrons to produce x-radiation and a coating distinct from said region for enhancing the thermal emittance of said body, said coating composed of a metal oxide coating comprising:

$Al_2O_3$ present in an amount of 50% to 80% by weight and $TiO_2$ together with $ZrO_2$ or $La_2O_3$ present in an amount of 50% to 20% by weight with the $TiO_2$ being present with respect to the $ZrO_2$ or $La_2O_3$ in a ratio in the range of 1:1 to 10:1.

2. The anode as defined in claim 1 wherein said $Al_2O_3$ is present in an amount of about 80% by weight and said $ZrO_2$ and said $TiO_2$ are present in an amount by weight of about 20% of said coating.

3. The anode as defined in claim 1 wherein said $ZrO_2$ is present in an amount by weight in the range of about 2% to 25% of said coating.

4. The anode as defined in claim 1 wherein said $ZrO_2$ is present in an amount by weight of about 2% of said coating.

5. The anode as defined in claim 1 wherein said $ZrO_2$ and said $TiO_2$ are present in equal amounts.

6. The anode as defined in claim 1 wherein said $ZrO_2$ is calcia stabilized.

7. A coating material for an x-ray tube anode comprised of a body having a surface region for being impinged by electrons to produce x-radiation, the coating adapted to be applied distinct from said region for enhancing the thermal emittance of said body, comprising:

a coating composed of a metal oxide mixture comprising $Al_2O_3$ particles present in an amount of 50% to 80% by weight and $TiO_2$ together with $ZrO_2$ or $La_2O_3$ present in an amount of 50% to 20% by weight with the $TiO_2$ being present with respect to the $ZrO_2$ or $La_2O_3$ in a ratio in the range of 1:1 to 10:1, said coating characterized by said aluminum oxide particles projecting from said coating when said coating is fused to said anode.

8. The coating material as defined in claim 7 wherein said $Al_2O_3$ is present in an amount of about 80% by weight and said $ZrO_2$ and said $TiO_2$ are present in an amount by weight in the range of about 20% of said coating material.

9. The coating material as defined in claim 7 wherein said $ZrO_2$ is present in an amount by weight in the range of about 2% to 25% of said coating material.

10. The coating material as defined in claim 7 wherein said $ZrO_2$ is present in an amount by weight of about 2% of said coating.

11. The coating material as defined in claim 7 wherein said $ZrO_2$ and said $TiO_2$ are present in equal amounts.

12. The coating material as defined in claim 7 wherein said $ZrO_2$ is calcia stabilized.

* * * * *